United States Patent [19]

Fritz et al.

[11] Patent Number: 4,855,723

[45] Date of Patent: Aug. 8, 1989

[54] AUDIO-VISUAL ALARM SYSTEM WITH ADDRESS DISPLAY

[75] Inventors: Marlene M. Fritz; Betty J. Love; Mary D. Sweeney, all of Dallas; Chuck Davis, Fort Worth, all of Tex.

[73] Assignee: Proto Quick, Inc., Dallas, Tex.

[21] Appl. No.: 187,934

[22] Filed: Apr. 29, 1988

[51] Int. Cl.[4] ..... G08B 5/36; G08B 13/24

[52] U.S. Cl. ..... 340/691; 40/902; 340/574; 362/800

[58] Field of Search ..... 340/691, 574; 40/902, 40/568, 451; 302/800, 802, 812

[56] References Cited

U.S. PATENT DOCUMENTS

| | | | |
|---|---|---|---|
| 3,624,635 | 11/1971 | Less | 340/326 |
| 3,863,236 | 1/1975 | Clardy | 340/326 |
| 3,911,425 | 10/1975 | Muncheryan | 340/326 |
| 4,058,919 | 11/1977 | Wakabayashi | 40/451 |
| 4,288,784 | 9/1981 | Fusco | 340/326 |
| 4,703,184 | 3/1988 | Bach | 340/691 |

*Primary Examiner*—Glen R. Swann, III

*Attorney, Agent, or Firm*—James C. Fails; Arthur F. Zobal; Geoffrey A. Mantooth

[57] ABSTRACT

An alarm system has an alarm unit that includes a siren, a stroboscopic light, and an address display. The alarm unit is located on a building so as to be visible from the building exterior. The address display is made up of one or more characters, arranged so as to make up the address of the building. The characters are formed by plural light emitting diodes. Switching circuitry activates the siren and the stroboscopic light, and switches the display to full brilliance. Reset circuitry deactivates the siren and the strobscopic light, and returns the display to a preactivation level of brilliance. A portable transmitter unit can be used to activate the alarm system. Interlock circuitry prevents the deactivation of the strob0scopic light and the address display before the siren is deactivated. The alarm system can be operated in one of two modes. The first mode has the siren operate continuously, and the second mode has the siren operate intermittently.

22 Claims, 6 Drawing Sheets

AUDIO-VISUAL ALARM SYSTEM WITH ADDRESS DISPLAY

FIELD OF THE INVENTION

The present invention relates to alarm systems for use in signalling for assistance in a medical or a security emergency.

BACKGROUND OF THE INVENTION

Alarm systems are useful for summoning assistance in emergency situations, particularly where, for whatever reason, one cannot phone for help. Prior art alarm systems typically provide a siren and a flashing light.

In emergency situations, emergency personnel look for the address to pinpoint the location of the house or building that they called to. The sirens and flashing lights of prior art alarm systems are useful for signalling that an emergency is nearby, but do not serve to quickly pinpoint the location of the emergency for emergency personnel. Therefore, what is needed is an alarm system that will, when activated, noticeably display the address of the house having the emergency.

It is an object of the present invention to provide an alarm system that is not subject to the disadvantages of the prior art.

SUMMARY OF THE INVENTION

The alarm system of the present invention includes an alarm unit, a master control unit, and a portable transmitter unit. The alarm unit includes a siren, a stroboscopic light means, an address display means, and a logic unit, all of which are contained within a housing which is adapted to be located on a building so as to be visible from the exterior of the building. The address display means includes one or more cards having a plurality of light sources arranged so as to describe a character of the building address. In one aspect of the invention, the light sources are light emitting diodes which are arranged in a seven segment fashion, where each segment has one or more LED's. The characters are slanted slightly from the vertical to enhance readability.

The logic unit of the alarm unit, and the master control unit have first switching means for activating the siren and the stroboscopic light means, and for switching the light sources in the address display means to a predetermined level of brilliance from a preactivation level of brilliance. The portable transmitter unit and the logic unit of the alarm unit have second switching means for activating the siren and the stroboscopic light means, and for switching the light sources in the address display means to a predetermined level of brilliance from a preactivation level of brilliance. When either the first or second switching means is used to activate the alarm system, the alarm system operates in a first operating mode, wherein the siren operates continuously, the stroboscopic light means is activated, and the address display means is switched to its full brilliance.

The alarm system has reset means for deactivating the siren, the stroboscopic light means, and for returning the address display means to the preactivation level of brilliance. The reset means has interlock means (in the logic unit) for preventing the deactivation of the stroboscopic light means and the address display means to a preactivation level of brilliance, before the siren is deactivated. The siren can be automatically deactivated after a predetermined period of time, and can also be manually deactivated from the master control unit.

A third switching means activates the alarm system into a second operating mode, wherein the siren operates intermittently and the stroboscopic light means and the address display means operate as in the first operating mode. The third switching means activates the alarm system from the master control unit. The alarm system is deactivated from the second operating mode by the reset means in the same manner as the first operating mode.

DESCRIPTION OF THE PREFERRED EMBODIMENT

Figure 1:
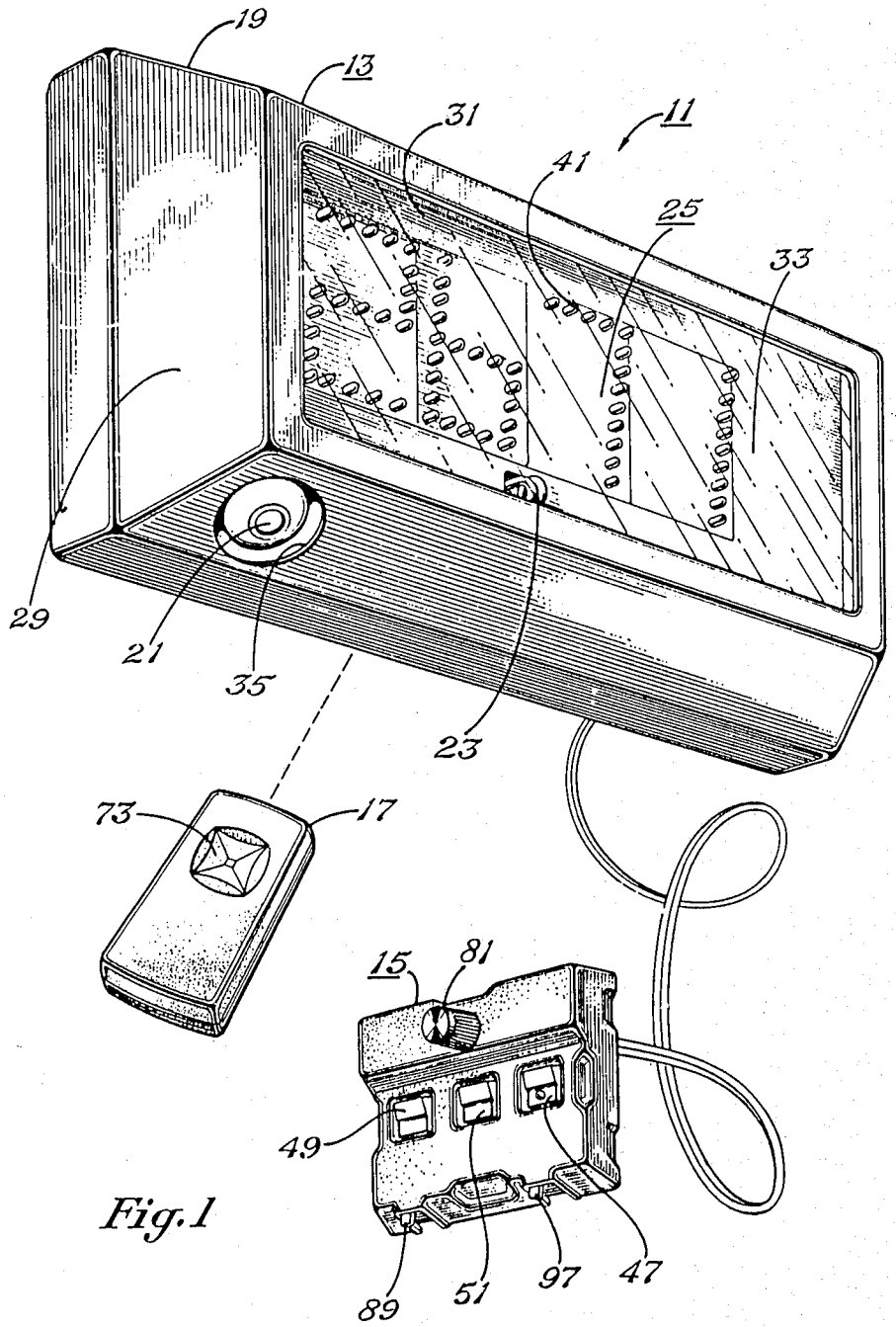
FIG. 1 is a perspective view of the alarm system of the present invention in accordance with a preferred embodiment.

In FIG. 1, there is shown a perspective view of the alarm system 11 of the present invention, in accordance with a preferred embodiment. The alarm system 11 of the present invention is used for summoning assistance in emergency situations by the activation of a siren, a strobe, and an address display to alert neighbors and emergency personnel. The alarm system is particularly useful where one cannot phone for assistance and must rely on neighbors to either assist directly or indirectly by getting help. The alarm system 11 of the present invention includes an alarm unit 13, a master control unit 15, and a transmitter unit 17.

The alarm unit 13 includes a housing 19, a siren 21, stroboscopic light means 23, address display means 25, and a logic unit (not visible in FIG. 1). The housing 19 has a front portion 29 and a back portion (not shown). The front and back portions are separable, allowing access to the interior compartment formed therein. The housing 19 houses the siren 21, the stroboscopic light means 23, the address display means 25, and the logic unit and protects these interior components from the elements. The front portion 29 has a darken or smoked transparent panel 31 positioned in front of the address display means 25 and the stroboscopic light 23 thus allowing the address display means 25 and the stroboscopic light means 23 to be viewed through the transparent panel from the exterior of the housing. The transparent panel 31 is darkened to reduce daylight glare, thus enhancing daylight visibility of the address display means 25 and the stroboscopic light 23. Surrounding the address display means and the stroboscopic light is a partition 33 that serves to frame the address display means 25 and the stroboscopic light 23, and hide the logic unit, which is located behind the address display means, from view. The front portion 29 also has a hole 35 cut in its underside to receive the siren 21. The siren 21 is a conventional siren of which there are many types that are commercially available. The stroboscopic light means is a conventional flasher unit comprising xenon tube and associated flasher circuitry. The xenon tube 23 is mounted in the housing 19 so as to be visible through the transparent panel 31.

Figure 4:
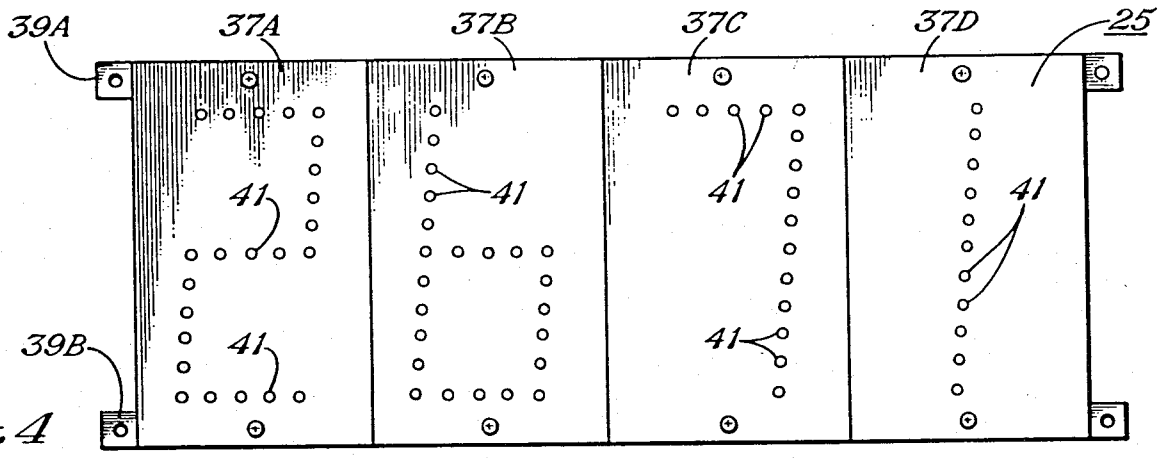
FIG. 4 is a front plan view of the address display means.
Figure 5:
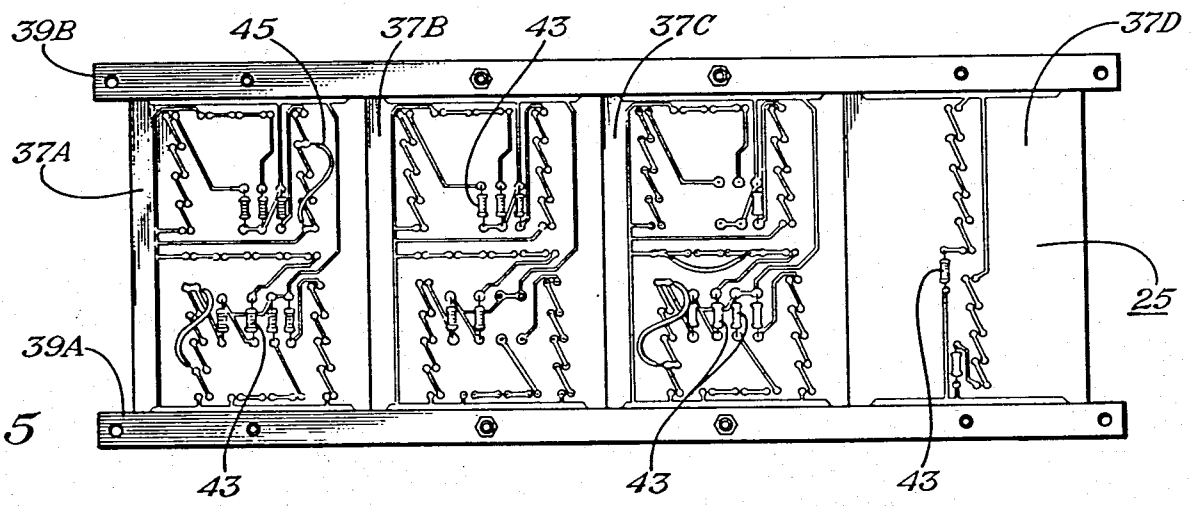
FIG. 5 is a rear plan view of the address display means of FIG. 4.

Referring to FIGS. 4 and 5, the address display means 25 includes one or more cards 37A, 37B, 37C, 37D and two bus bars 39A, 39B. Each card has a plurality of light sources 41 that describe a character. The characters are selected and arranged so as to make up the address of the building upon which the alarm unit 13 will be mounted. The cards 37 are mounted to the bus bars 39A, 39B which provide electrical power and structural strength.

In the preferred embodiment, the light sources are light emitting diodes (LED's) 41. In the preferred embodiment, the characters, which are usually numerical, are described by the LED's in a seven segment arrangement. The phrase "seven segment arrangement" is used herein as that phrase is generally understood to mean in the electronics industry, wherein a character, particularly a numerical character, is displayed by using two or more segments of light sources out of a total of seven segments. In describing the use of the segment arrangements, it will be convenient to refer to "upper", "center", "lower", "left", and "right" with reference to the orientation of the address display means of FIG. 4. As an example of the use of the seven segment arrangement, the character "1" (on card 37D in FIGS. 4 and 5) is made up of two segments. One segment includes the five uppermost LED's 41 connected in series. The other segment includes the six lowermost LED's 41 connected in series. The individual LED segments are connected in series with a respective resistor 43 and in parallel to other segments across a 22 volt power supply. The LED's are mounted onto the cards in accordance with conventional practices. As another example, the character "6" (on card 37B) is made up of five segments: the upper left vertical segment having five LED's, the center horizontal segment having five LED's, the lower left vertical segment having five LED's, the lower right vertical segment having five LED's, and the lower horizontal segment having three LED's. For manufacturing purposes, consistency from card to card is maintained by wiring the LED's for a given character in the sam relative segment from card to card and character to character, even if a segment has only one LED. For example, the character "2" (on card 37A) utilizes a single LED in the lower right vertical segment which is the LED in the lower right corner of the character. This LED is connected to the power supply by way of a jumper cable 45.

The value of the resistor 43 chosen for a particular segment depends on the number of LED's in that segment. The fewer LED's there are in a particular segment, the higher the resistance that is needed to limit current. In the preferred embodiment, the type of LED's used are Hewlett Packard T1-3/4 HLMP 3850. The current passing through an individual LED segment is limited to 16 to 19 milliamps, which current will drive the LED's at close to full brilliance. Higher currents will result in slightly higher brilliances, but such higher brilliances are undiscernable to the human eye. When discussing the brilliance of the address display means hereinafter, the term full brilliance will be used to indicate near full brilliance.

The LED's are spaced apart from one another 0.4 to 0.5 inches. The dimensions of the characters are 2 inches wide by 4 inches high. The characters are slanted 3 degrees from the vertical such that the upper portion of each character is further to the right than the lower portion. The spacing of the LED's and the slant of the characters enhance optimum visibility and readability.

The cards 37A, 37B, 37C, 37D are arranged along the length of the bus bars 39A, 39B so as to make up the desired building address. The rear portion of the cards are fastened to the bus bars so that one bus bar 39A is at the upper ends of the cards and the other bus bar 39B is at the lower end of the cards. The bus bars provide a framework for mounting the cards as well as electrical power to each card.

Figure 2A:
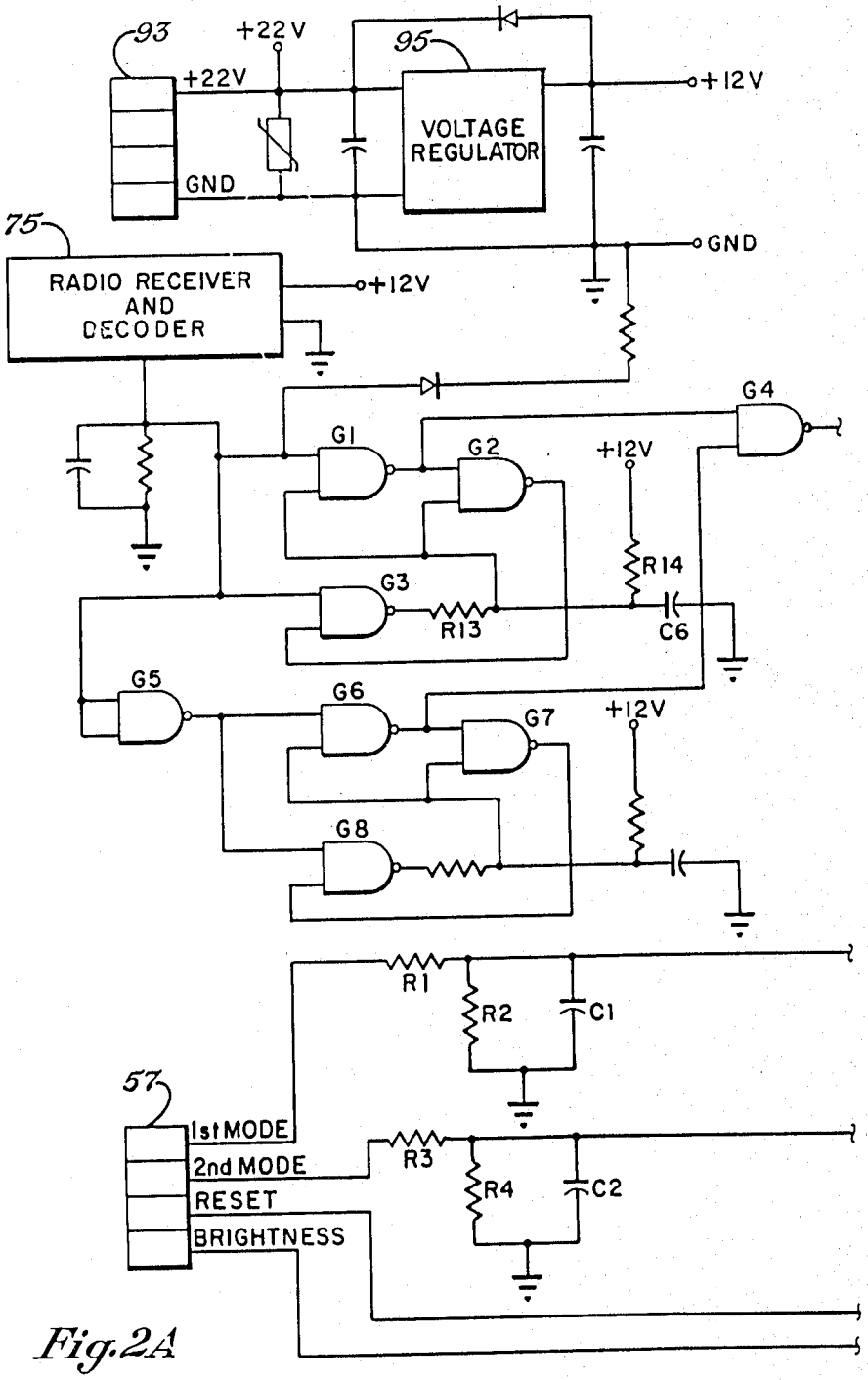
FIGS. 2A through 2C are electrical circuit diagrams which show respective portions of the logic unit.
Figure 2B:
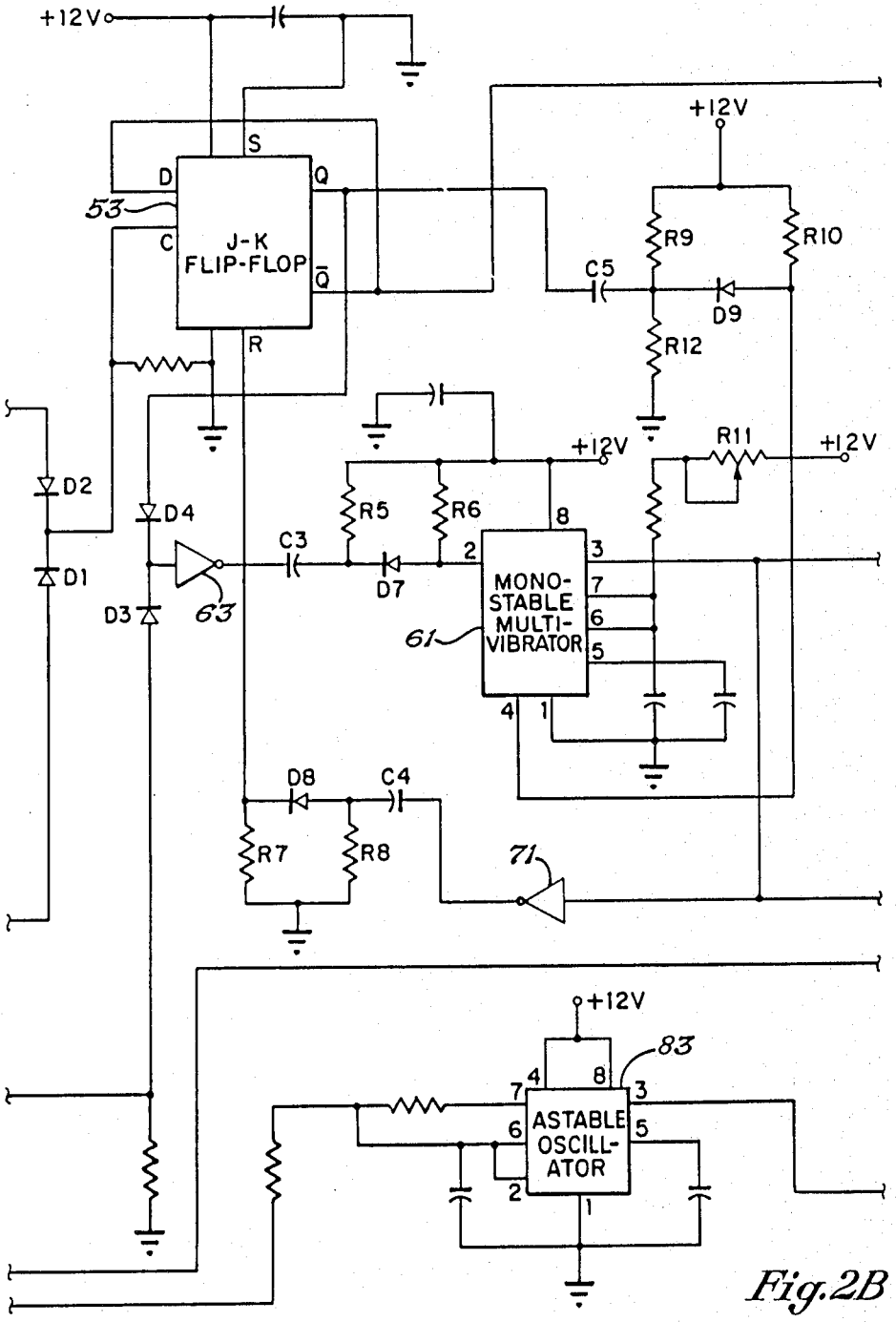
Figure 2C:
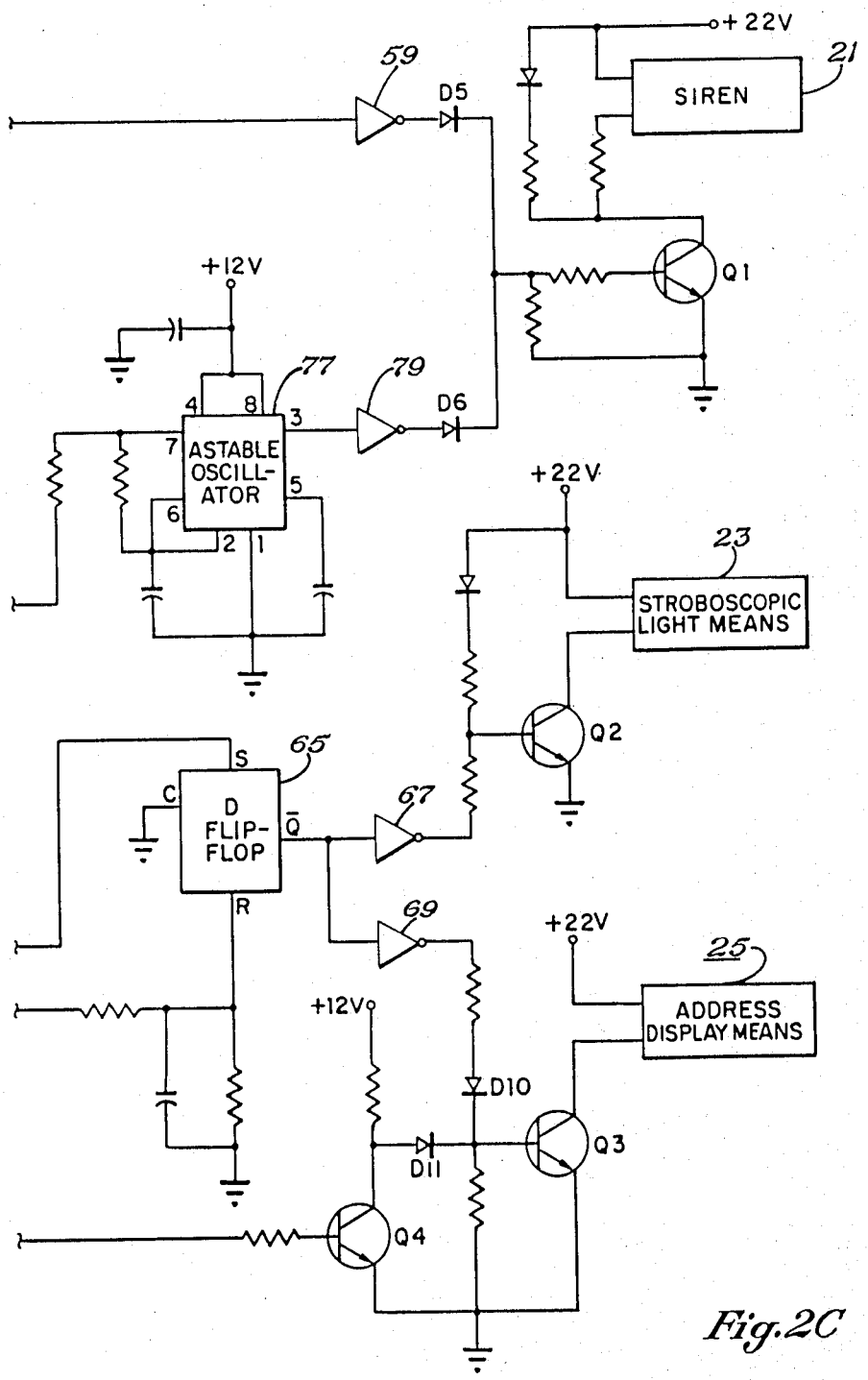

The logic unit of the alarm unit will now be described, along with the master control unit 15. For purposes of clarity, the logic unit and the master control unit will be described according to their functions. The master control unit 15 is shown in FIG. 1 and is also shown in electrical schematic form in FIG. 3. The master control unit has switches 47, 49, 51 which are operated by an operator to activate and deactivate the alarm system. The logic unit is shown in electrical schematic form in FIGS. 2A, 2B, and 2C.

The logic unit of the alarm unit, and the master control unit have first switching means for activating the siren 21 and the stroboscopic light means 23, and for switching the light sources 41 in the address display means 25 to a predetermined level of brilliance from a preactivation level of brilliance. The portable transmitter unit 17 and the logic unit of the alarm unit have second switching means for activating the siren 21 and the stroboscopic light means 23, and for switching the light sources 41 in the address display means 25 to a predetermined level of brilliance from a preactivation level of brilliance. When either the first or the second switching means is used to activate the alarm system, the alarm system operates in a first operating mode, wherein the siren 21 is activated to operate in a continuous fashion, the stroboscopic light means 23 is activated, and the address display means 41 are switched to their full brilliance. The activation of the alarm system into the first operating mode, by the first switching means which is via the master control unit, will now be described. To activate the alarm system into the first operating mode, the first mode switch 47 in the master control unit 15 is activated by an operator for momentary closure. When activated, the first mode switch 47 (see FIG. 3) connects +12 volts to the clock input C of the J-K flip-flop 53 (see FIG. 2B) via: terminal boards 55, 57; an integrator debounce circuit, which is composed of resistors R1 and R2, and capacitor C1 (see FIG. 2A); and diode D1. The J-K flip-flop 53 is converted from a D flip-flop by tying the Q output to the D input. The $\overline{Q}$ output of the flip-flop goes low and turns on power transistor Q1 (see FIG. 2C), via an inverter 59 and diode D5, to activate the siren 21. The Q output of the flip-flop 53 is connected to one of the inputs (pin, 2) of the integrated circuit 61 (which is a 555 timer, configured as a monostable multivibrator) through: diode D4; an inverter 63; a differentiating circuit, which is composed of resistors R5 and R6, and capacitor C3; and diode D7. The differentiating circuit passes negative going transients to pin 2 of the monostable multivibrator 61. The output (pin 3) of the monostable multivibrator 61 is connected to the S input of the D flip-flop 65 (see FIG. 2C); thus a negative transient appearing at pin 2 of the monostable multivibrator causes the output (pin 3) to go high, which sets the $\overline{Q}$ output of the D flip-flop 65 to low. When the $\overline{Q}$ output of the flip-flop 65 is low, the power transistor Q2 is operated through inverter 67, whereby the stroboscopic light means 23 is activated, and the power transistor Q3 is operated through inverter 69 and diode D10, whereby the LED's of the address display means are operated at full brilliance.

The logic unit and the master control unit has reset means for deactivating the siren, the stroboscopic light means, and for returning the address display means to a preactuation level of brilliance. Deactivation of the siren can occur either automatically or manually while deactivation of the stroboscopic light means and the address display means can occur only manually. In addition, the logic unit portion of the reset means has interlock means for prohibiting the deactivation of the stroboscopic light means 23 and the address display means while the siren is activated. Thus, the siren must first be deactivated, either automatically or manually, before the stroboscopic light means and the address display means are manually deactivated. This interlock feature inhibits unauthorized deactivation of the alarm system. Thus, an unauthorized intruder into a home equipped with the alarm system of the present invention would find it difficult to completely deactivate the alarm system.

The siren will be automatically deactivated by allowing the monostable multivibrator 61 to time out after a predetermined period of time. The amount of time that the output pulse at pin 3 remains high is adjusted by potentiometer R11 and is usually set to five to ten minutes. Some localities have ordinances regulating the length of time a siren can be kept on. When the monostable multivibrator times out, it returns to the stable condition, wherein the output (pin 3) goes low. The low output is converted to a high signal by an inverter 71. A differentiating circuit, composed of resistors R7 and R8, capacitor C4, and diode D8 passes a positive transient to the R input of the J-K flip-flop 53. This resets the flip-flop 53 and causes output Q to go low and output $\overline{Q}$ to go high. When output $\overline{Q}$ goes high, the transistor Q1 is turned off and the siren 21 is deactivated.

Figure 3:
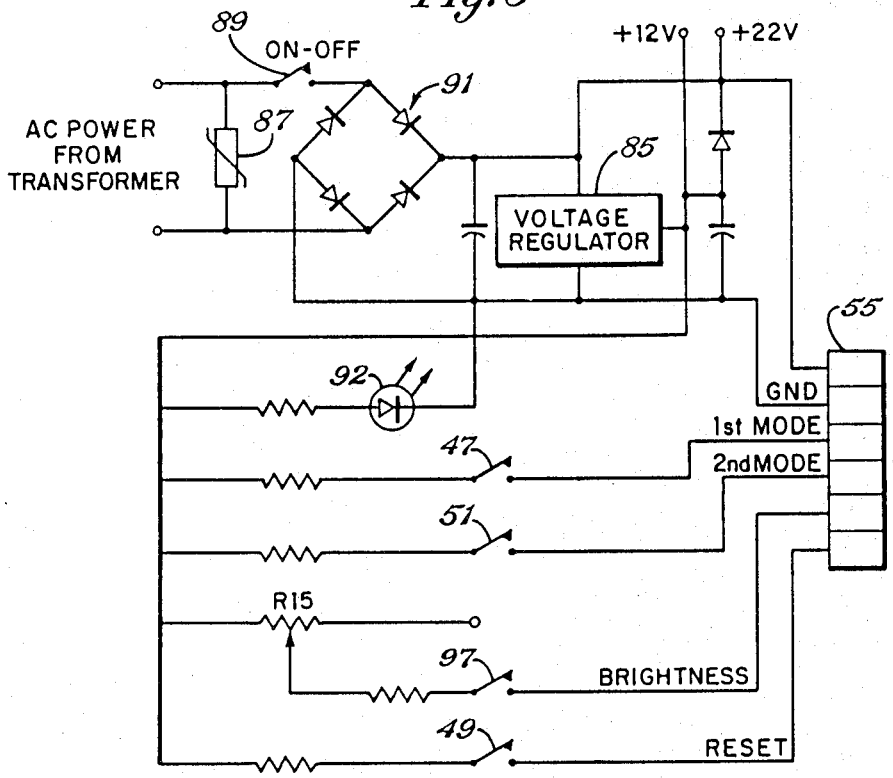
FIG. 3 is an electrical circuit diagram of the master control unit.

With the output Q of the flip-flop 53 low, the output (pin 3) of the monostable multivibrator 61 is also low, setting the stage for manual resetting by deactivating the stroboscopic light means 23 and returning the LED's of the address display means 25 to the preactivation level of brilliance. The alarm system is reset by manually activating the reset switch 49 in the master control unit 15 (FIG. 3). Activation of the reset switch 49 results in momentary closure of the switch and connects the power supply voltage of 12 volts to the R input of the D flip-flop 65. This resets the D flip-flop 65, causing output $\overline{Q}$ to go high, thus turning off transistors Q2 and Q3, which respectively deactivates the stroboscopic light means 23 and returns the LED's of the address display means 25 to their preactivation level of brilliance. The alarm system is now ready to be activated again.

The siren may be manually deactivated before the monostable multivibrator 61 is timed out by activating the first mode switch 47. This resets the J-K flip-flop 53 and causes output Q to go low and output $\overline{Q}$ to go high. When output $\overline{Q}$ goes high, the transistor Q1 is turned off and the siren is deactivated. As output Q goes low, a differentiating circuit, which is composed of resistors R9, R10 and R12, capacitor C5, and diode D9, passes a negative going transient to pin 4 of the monostable multivibrator 61 wherein the monostable multivibrator is reset so that the output (pin 3) is low. The stroboscopic light means and the address display means can now be deactivated by activating the reset switch 49 as described above.

As mentioned hereinabove, there is a second method of activating the alarm system of the present invention into the first operating mode, which method utilizes the second switching means of the portable transmitter unit 17 and the logic unit of the alarm unit. To activate the alarm system remotely, the transmitter switch 73 (see FIG. 1) on the transmitter unit 17 is activated by an operator. The transmitter unit transmits a radio signal, which is received and decoded by the radio receiver and decoder 75 in the logic unit (see FIG. 2A). The transmitter unit 17 and the radio receiver and decoder 75 are conventional. The output of the radio receiver and decoder 75 is connected to first and second change detectors. The change detectors, which include NAND gates G1-8, are utilized because the form of the output of the radio receiver and decoder 75 depends on the type of unit used. The change detectors take the output of the radio receiver and decoder 75, whatever the form of the output, and convert it into an output signal of constant form. For example, one type of radio receiver and decoder produces a high (or positive) pulse having a duration equal to the activation of the transmitter switch. Another type of radio receiver and decoder changes state from low to high or high to low whenever the transmitter switch 73 is activated. For this latter type of radio receiver and decoder, the release of the transmitter switch goes unnoticed. Therefore, the change detectors produce a high or positive pulse for every valid radio transmission. The output of the change detectors is connected to the C input of the J-K flip-flop 53, through diode D2. The diodes D1 and D2 form an OR gate wherein the C input of the J-K flip-flop 53 can be activated by either the first mode switch 47 in the master control unit 15 or the transmitter switch 73 in the transmitter unit 17.

The configuration of the change detectors will now be described. The first change detector is composed of Schmitt trigger NAND gates G1, G2, and G3, resistors R13, R14, and capacitor C6. The output of the radio receiver and decoder 75 is connected to one of the inputs of gates G1 and G3. The output of gate G3 is connected to the other input of gate G1 and one of the inputs of gate G2. The output of gate G1 is connected to the other input of gate G2 and is the output of the first change detector. The output of gate G2 is connected to the other of the inputs of gate G3. The resistors R13, R14, and capacitor C6 are pulse width expanders. The second change detector is configured identical to the first change detector, using Schmitt trigger NAND gates G6-8, except the output of the radio receiver and decoder 75 is connected to the second change detector via a NAND gate G5, which is configured as an inverter. The respective outputs of the first and second change detectors are connected to the respective inputs of NAND gate G4. The output of gate G4 is connected to the C input of the J-K flip-flop via diode D2.

When the transmitter switch 73 is activated, the signal presented to the C input of the J-K flip-flop 53 is a positive signal, which is the same type of signal that is presented to the C input by the first mode switch 47 of the master control unit. Thus, the transmitter switch activates and deactivates the alarm system in the same manner as the first mode switch 47, described hereinabove.

A third switching means activates the alarm system into a second operating mode, wherein the siren operates intermittently, and the stroboscopic light means and the address display means operate as in the first operating mode. The alarm system is activated into the second operating mode by way of the master control unit 15, and specifically by activating the second mode switch 51. The second mode switch 51 is connected to the input (pin 2) of the monostable multivibrator 61 through: an integrator debounce circuit, composed of resistors R3 and R4, and capacitor C2; diode D3; inverter 63; and the differentiating circuit, which is composed of resistors R5, R6, capacitor C3, and diode D7. The diodes D3 and D4 form an OR gate, wherein the input (pin 2) of the monostable multivibrator 61 can be activated by either the second mode switch 51 or the Q output of the J-K flip-flop 53. A negative or low signal appearing at pin 2 of the monostable multivibrator 61 results in a high signal at the output (pin 3), which triggers a first astable oscillator 77 (which includes a 555 timer integrated circuit). The output (pin 3) of the first astable oscillator 77 is connected to the base of transistor Q1 through inverter 79 and diode D6. The first astable oscillator 77 drives the transistor Q1 in an oscillating fashion, resulting in intermittent operation of the siren.

The first astable oscillator 77 is always triggered when pin 3 of the monostable multivibrator 61 is high. However, because the output of the first astable oscillator is connected to the transistor Q1 through an OR gate, in the form of diodes D5, D6, any continuous signal appearing at diode D5 masks the oscillatory signal appearing at diode D6. Such a continuous signal occurs when the alarm system is activated into the first operating mode.

When the output (pin 3) of the monostable multivibrator 61 goes low, as described hereinabove, the first astable oscillator 77 is turned off, thus deactivating the siren. Thus, the alarm system is deactivated from the second operating mode the same as for the first operating mode.

The brightness of the LED's in the address display means can be adjusted with a brightness control knob 81 on the master control unit 15 (see FIG. 1). The brightness control knob 81 is connected to a brightness control potentiometer R15 (see FIG. 3) in the master control unit which is connected to pins 2, 6, and 7 of a second astable oscillator 83 (which includes a 555 timer integrated circuit) via the terminal boards 55, 57. The output (pin 3) of the second astable oscillator 83 (see FIG. 2B) is connected to the base of the transistor Q4 (see FIG. 2C) which amplifies the oscillations. The output of the transistor Q4 is connected, through diode D11, to the base of the power transistor Q3. The LED's of the address display means 25 are thus driven in an oscillatory fashion when in the preactivation mode. The frequency of oscillation is too fast to be discernable to the human eye. At low oscillating frequencies, the LED's operate at low levels of brilliance. At higher oscillation frequencies, the LED's operate at higher levels of brilliance. The second astable oscillator 83 is connected to the power transistor Q3 through diode D11. Diodes D10 and D11 form an OR gate, thus, when the LED's are activated through the D flip-flop 65, the LED's will be driven at full brilliance. The brightness control circuit allows the address display means 25 to be left on all of the time at some selected level of brilliance. When the alarm system is activated, the address display is illuminated at full brilliance. A switch 97 in the master control unit 15 turns off the address display when the alarm system is not activated.

Electrical power is supplied to the alarm system from an ac 120 volt, 60 hz source. A transformer (not shown) reduces the voltage down to 22 volts. In the master control unit 15 (see FIG. 3), the output from the transformer is connected to a voltage regulator 85 through a metal oxide varistor 87, an on-off switch 89, and a diode bridge 91. An LED 92, when lit, indicates that the alarm system is on. The voltage regulator 85 provides a 12 volt supply to the logic unit via the switches in the master control unit. The 22 volt supply is connected, through terminal boards 55, 93, to a voltage regulator 95 in the logic unit.

The alarm unit 13 is located on a house so as to be visible from the exterior of the house. The alarm unit is adapted to be located on the outside of the house, and should be positioned so that the address display is visible from the street. The master control unit 15 is typically positioned on an interior wall in a convenient location. The transmitter unit 17 is compact and portable and may be worn by an occupant of the house.

The second operating mode of the alarm system, wherein the siren operates intermittently, serves several purposes. First, the second mode switch 51 and associated circuitry can be used as a connection point for other alarm systems, especially for those types of systems that sound an alarm at a remote site such as a police station. Second, the two types of audio alarms, continuous and intermittent, allows for a coded alarm signal to go out to neighbors. For example, the intermittent siren operation could signal an emergency situation wherein the alarm has been sounded at the local police station. Neighbors would then be appraised of an emergency situation, but need not take any action.

The address display means of the present invention is, when mounted on the exterior of a building such as a typical residence, visible from the street that is adjacent to the residence and is also visible from houses across the street. Thus, in an emergency situation, emergency personnel, when traveling along the street searching for the residence, are able to easily spot the address and quickly pinpoint the location of the residence.

Although the address display means has been described with specificity concerning the cards, the use of a seven segment arrangement to describe address characters, type of LED's, and spacing of LED's, an address display means of the present invention can be made in other ways. For example, instead of using one card per character, plural characters can be put on a card. Also, arrangements other than the seven segment type can be used to describe the characters. The spacing between individual LED's in a character depends on the physical site and available brightness of the particular type of LED's that are selected. Some types of LED's are capable of more brilliance than other types. The brilliance of the LED's depends on the amount of voltage and current used to drive the LED's.

The foregoing disclosure and a showing made in the drawings are merely illustrative of the principles of this invention and are not to be interpreted in a limiting sense.

We claim:

1. An alarm system, comprising:

(a) an alarm unit adapted to be located on a building so as to be visible from the exterior of said building, said alarm unit comprising a siren, stroboscopic light means, and address display means;

(b) said address display means having one or more characters arranged so as to make up the address of said building, with each character being formed by a plurality of light sources;

(c) switching means for activating said siren and said stroboscopic light means, and for switching said light sources of said address display means to a predetermined level of brilliance from a preactivation level of brilliance (d) reset means for deactivating said siren and said stroboscopic light means, and for returning said light sources of said address display means to the preactivation level of brilliance, so as to be in a state of readiness wherein when said switching means is actuated again said switching means will activate said siren and said stroboscopic light means and switch said light sources of said address display means to said predetermined level of brilliance.

2. The alarm system of claim 1 wherein said light sources are light emitting diodes.

3. The alarm system of claim 2 wherein said switching means is a first switching means, the alarm system further comprising:

(a) second switching means for activating said siren and said stroboscopic light means, and for switching said light sources of said address display means to a predetermined level of brilliance, said second switching means comprising portable radio transmitter means which communicates with radio receiver means in said alarm unit.

4. The alarm system of claim 3 wherein said reset means comprises interlock means for preventing the deactivation of said stroboscopic light means and the return of said address display means to a preactivation level of brilliance before said siren is deactivated, whereby said stroboscopic light means and said address display means can be deactivated only after said siren is deactivated.

5. An alarm system, comprising:

(a) an alarm unit adapted to be located on a building so as to be visible from the exterior of said building, said alarm unit comprising a siren, stroboscopic light means, and address display means;

(b) said address display means having one or more characters arranged so as to make up the address of said building, with each character being formed by a plurality of light sources;

(c) said light sources comprising point sources of light, with the point light sources that form each character being spaced apart from one another so that each character is readable at a distance;

(d) switching means for activating said siren and said stroboscopic light means, and for switching said light sources of said address display means to a predetermined level of brilliance from a preactivation level of brilliance.

6. The alarm system of claim 5 wherein said light sources are light emitting diodes.

7. The alarm system of claim 6 wherein said light sources that form each character are wired together in segments that contain one or more light sources, said characters utilizing plural segments that are arranged in seven-segment fashion.

8. The alarm system of claim 7 wherein said characters comprise vertical segments, which vertical segments are slanted from the vertical to enhance readability of said characters.

9. The alarm system of claim 8 wherein said predetermined level of brilliance is brighter than said preactivation level of brilliance.

10. The alarm system of claim 5 wherein said switching means comprises means for automatically deactivating said siren after a predetermined period of time.

11. The alarm system of claim 10 wherein said switching means provides plural modes of operation for said siren, said modes comprising a first mode wherein said siren operates continuously and a second mode wherein said siren operates intermittently, said switching means comprising oscillator means for operating said siren in said second mode.

12. The alarm system of claim 11 wherein:

(a) said light sources comprise light emitting diodes;

(b) said length sources that form each character are wired together in segments that contain one or more light sources, said characters utilizing plural segments that are arranged in seven-segment fashion;

(c) said characters comprise vertical segments, which vertical segments ar slanted from the vertical to enhance readability of said characters;

(d) said predetermined level of brilliance is brighter than said preactivation level of brilliance.

13. The alarm system of claim 12 wherein said switching means is a first switching means, the alarm system further comprising second switching means for activating said siren and said stroboscopic light means, and for switching said light sources of said address display means to said predetermined level of brilliance, said second switching means comprising portable radio transmitter means which communicates with radio receiver means in said alarm unit.

14. The alarm system of claim 5 wherein said switching means is a first switching means, the alarm system further comprising:

(a) second switching means for activating said siren and said stroboscopic light means, and for switching said light sources of said address display means to said predetermined level of brilliance, said second switching means comprising portable radio transmitter means which communicates with radio receiver means in said alarm unit.

15. The alarm system of claim 14 wherein said second switching means comprises change detector means for detecting a change in the output of said radio receiver means when activated by said radio transmitter means.

16. The alarm system of claim 5 wherein the brilliance of said address display means is regulated by variable frequency oscillator means, wherein when said oscillator means operates at low frequencies said address display means has a low brilliance, and for higher operating frequencies of said oscillator means, said address display means has a higher brilliance. portable radio transmitter means which communicates with radio receiver mean sin said alarm unit.

17. An alarm system, comprising:

(a) an alarm unit adapted to be located on a building so as to be visible from the exterior of said building, said alarm unit comprising a siren, stroboscopic light means, and address display means;

(b) said address display means having one or more characters arranged so as to make up the address of said building, with each character being formed by a plurality of light sources;

(c) switching means for activating said siren and said stroboscopic light means, and for switching said light sources of said address display means to a predetermined level of brilliance from a preactivation level of brilliance, said predetermined level of brilliance being brighter than said preactivation level of brilliance;

(d) said light sources comprising point sources of light, each of said point sources of light that form each character being separated from adjacent point sources by distances that permit the respective character to be read at a distance away from said address display means when said address display means is illuminated at said predetermined level of brilliance, said point light sources forming characters that slant from the vertical, whereby said address can be read by humans looking for said building;

(e) means for deactivating said siren and said stroboscopic light means and for returning said light sources of said address display means to the preactivation level of brilliance, so as to be in a state of readiness wherein when said switching means is actuated again said switching means will activate said siren and said stroboscopic light mean and switch said light sources of said address display means to said predetermined level of brilliance.

18. The alarm system of claim 17 wherein said light sources comprise light emitting diodes, said light emitting diodes that form each character being separated from each other by 0.4–0.5 inches.

19. the alarm system of claim 18 wherein said characters are slanted from the vertical by three degrees.

20. The alarm system of claim 17 wherein said characters are slanted from the vertical by three degrees.

21. The alarm system of claim 20 wherein said switching means comprises means for automatically deactivating said siren after a predetermined period of time, said switching means provides plural modes of operation for said siren, said modes comprising a first mode wherein said siren operates continuously and a second mode wherein said siren operates intermittently, said switching means comprising oscillator means for operating said siren in said second mode.

22. The alarm system of claim 21 wherein said switching means is a first switching means, the alarm system further comprising second switching means for activating said siren and said stroboscopic light means, and for switching said light sources of said address display means to said predetermined level of brilliance, said second switching means comprising protable radio transmitter means which communicates with radio receiver means in said alarm unit.

* * * * *